United States Patent [19]

Meratti

[11] 4,143,438

[45] Mar. 13, 1979

[54] OPENER FOR OPENING SIGNATURES HAVING AN OVERLAP

[76] Inventor: Gianattilio Meratti, Torre de' Roveri (Bergamo), Italy

[21] Appl. No.: 852,642

[22] Filed: Nov. 18, 1977

[30] Foreign Application Priority Data

Jan. 20, 1977 [IT] Italy ..... 67116 A/77

[51] Int. Cl.[2] ..... B42C 19/00

[52] U.S. Cl. ..... 11/1 R

[58] Field of Search ..... 11/1 R

[56] References Cited

U.S. PATENT DOCUMENTS

| | | | |
|---|---|---|---|
| 2,170,049 | 8/1939 | Faeber | 11/1 R |
| 3,881,204 | 5/1975 | Sato | 11/1 R |

*Primary Examiner*—Harrison L. Hinson

*Attorney, Agent, or Firm*—Sughrue, Rothwell, Mion, Zinn and Macpeak

[57] ABSTRACT

A signature opener for opening signatures having either an upper or lower positioned overlap, the opener having a conveyor, a pair of opposed rotatably mounted opening member and a drive therefor, for selectively engaging the upper or lower positioned overlap and pushing the part of the signature having the overlap away from the other part, thereby opening or initiating the opening of the signature.

6 Claims, 3 Drawing Figures

OPENER FOR OPENING SIGNATURES HAVING AN OVERLAP

BACKGROUND OF THE INVENTION

Normally, signatures are opened sufficiently far to place them on a saddle for sewing to other signatures to form a book, though the signatures may be opened for other purposes such as the insertion of additional sheets. There is a known opener which has an opening member in the form of an oscillating finger which can lift a top overlap, thus initiating the opening of the signature. However, the signatures must all be printed and cut so as to have the overlap in the same position, in this particular case on the upper part of the signature. Nonetheless, it would be convenient to print and cut signatures so that they do not all lie with the overlap in the same position, a stack of signatures thus having some overlaps on the upper part and some overlaps on the lower part.

OBJECT OF THE INVENTION

It is an object of this invention to provide an opener which can open signatures having overlaps, whichever way up the signatures are.

THE INVENTION

According to the invention, there are two opening members rotatably mounted about the same axis, the opening members and the respective drives being arranged such that the opening members operate in different directions, and the opener includes control means for energizing one of the opening members at a time, so that signatures having overlaps can be opened whichever way up the signatures are.

ADVANTAGES OF THE INVENTION

The invention provides a simple construction which can meet the object of the invention. In addition, the opening members can be incorporated in an opener for instance having suckers for opening signatures having no overlap, giving to the opener a great versatility; in other words in one opener one can open signatures whether they have an overlap or not and whichever way up the signatures are.

Normally, the order in which the signatures are on the stack will have been determined by the printing and cutting or folding operations, and the control means can be programmed accordingly, though it would be feasible to sense the position of the overlap and actuate the control means in accordance with such sensing.

BRIEF DESCRIPTION OF THE DRAWINGS

The invention will be further described, by way of example, with reference to the accompanying drawings, in which.

DETAILED DESCRIPTION OF ONE EMBODIMENT OF THE INVENTION

Figure 2:
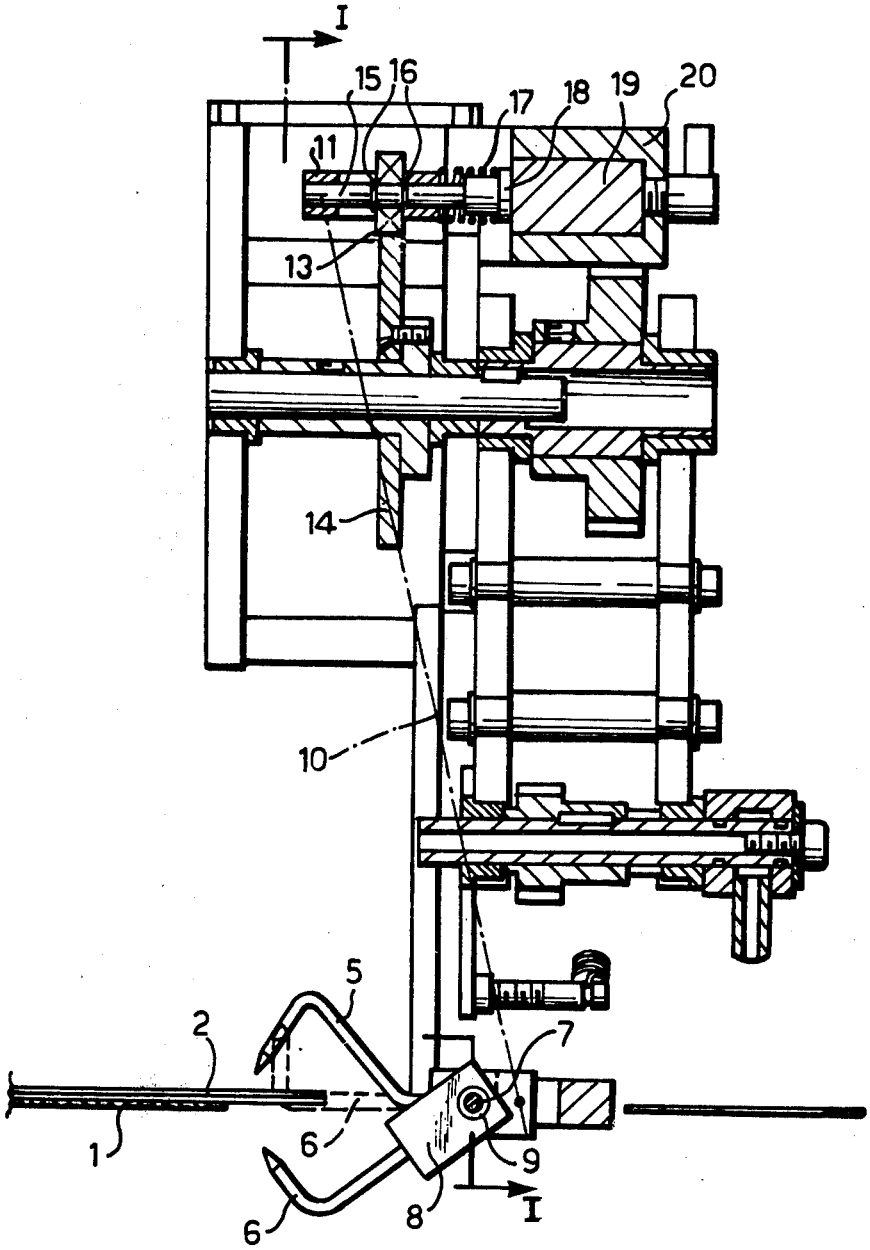
FIG. 2 is a vertical section along the line II—II of FIG. 1.

The invention is shown applied to a feeder having a series of suckers for opening successive signatures. An example of such a feeder is the Headop feeder manufactured by Meccanotecnica S.p.A. of Bergamo, Italy, and there are descriptions of suitable feeders in British Patent Specification No. 1 234 720 and in U.S. Patent Appln. No. 601 270 (corresponding to Italian Patent Application No. 68816-A/75). The feeder has a conveyor which includes a support 1 for the successive signatures 2, the edges of the signatures 2 projecting laterally beyond the support 1 as can be seen in FIG. 2. The signatures 2 are conveyed with their spines trailing and the overlap on the leading edge, i.e. the overlap projects forwards beyond the remainder of the signature 2. The feeder has a number of suckers 3 which can rotate or oscillate in order to open signatures not having an overlap and are controlled by a programmer (not shown). The feeder also has a member 4 for entering the successive partly-opened signatures 2 and opening them sufficiently to place them upon a saddle (not shown) at the end of the conveyor. The drives for the suckers 3 and member 4 and the suction arrangement are not described in detail because they are known.

Figure 1:
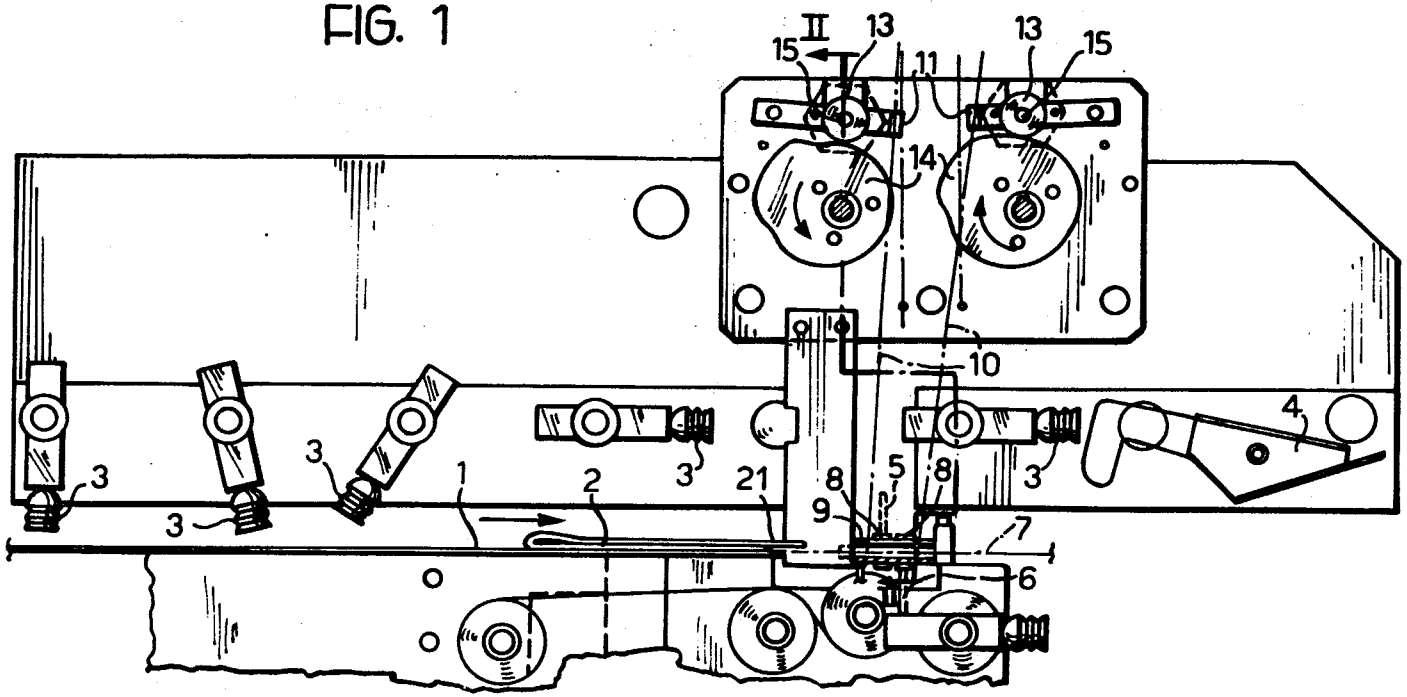
FIG. 1 is a side view, mainly in vertical section along the line I—I of FIG. 2, of an opener in accordance with the invention.
Figure 3:
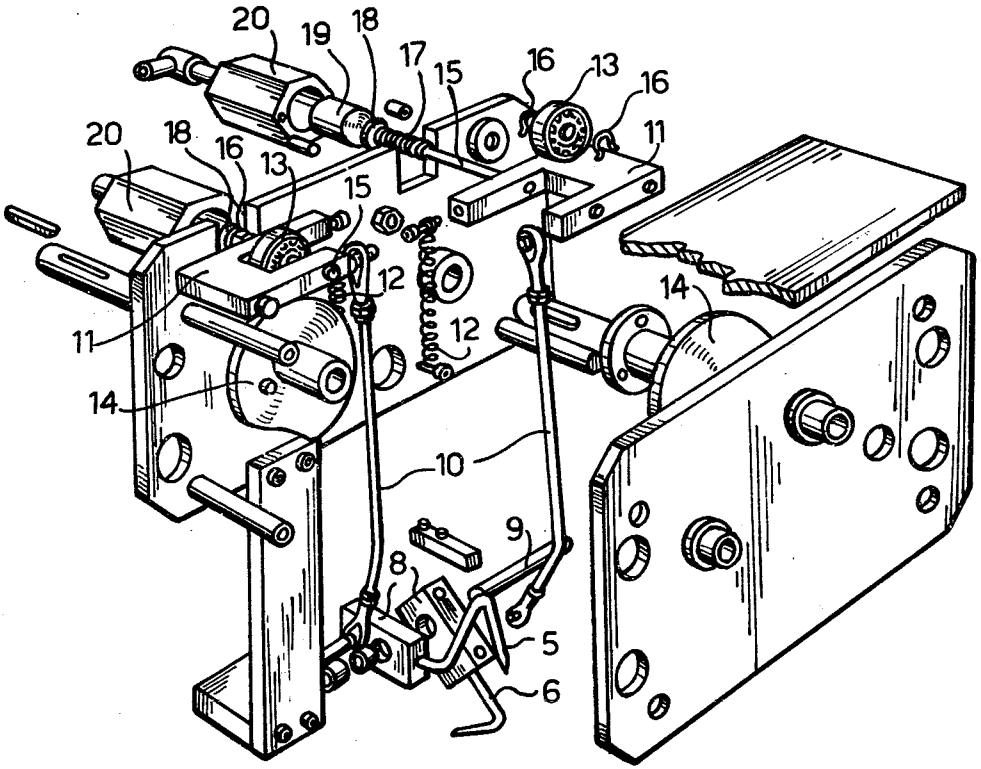
FIG. 3 is an exploded, perspective view of the opener.

According to the invention, there are two opening members in the form of fingers 5 and 6 rotatably mounted about the same axis 7 which is to one side of the conveyor, in the plane of conveyance, and parallel with the direction of conveyance. The fingers 5 and 6 are fixed to blocks 8 which pivot on a stationary shaft 9 and are oscillated by means of connecting rods 10. One connecting rod 10 is connected to the respective block 8 on one side of the common axis 7 of the fingers 5 and 6 and the other connecting rod 10 is connected to the other block 8 on the other side of the common axis 7 so that the connecting rods 10 themselves can carry out similar motions, thus simplifying the design of the arrangement. The connecting rods 10 are only indicated schematically in FIGS. 1 and 2. The upper ends of the connecting rods 10 are connected to pivoting members 11 which are drawn (spring loaded) by springs 12 (only shown in FIG. 3) towards end stops (not shown) and carry cam follower rollers 13. As can be seen in FIG. 2, each roller 13 is rotatably mounted on, but is effectively fixed to as regards axial movement by means of circlips 16, a small shaft 15. The shaft 15 is spring biassed by means of a spring 17 into a position in which the roller 13 engages a cam 14, and the end of the shaft 15 carries a head 18 which forms an abutment surface for engagement by an abutment member 19. The abutment member 19 forms part of a pressure-fluid actuator in the form of a pneumatic piston-cylinder unit 20. On actuation of the unit 20, the shaft 15 is thrust against its spring biassing to displace the roller 13 from the path of the cam 14. Each respective cam 14 is driven continuously by a known drive, and is profiled such that the respective roller 13 does not engage the surface of the cam 14 in at least one arc of rotation of the cam 14. The actuator unit 20 is automatically controlled by known means (not shown) such that it is actuated in this arc. As can be seen in FIG. 2, when the head 18 and the member 19 are in their respective right-hand end positions, there is a small gap between the head 18 and the member 19, thereby preventing undue engagement between the head 18 and the member 19 when the roller 13 is being oscillated by the cam 14. The actuating unit 20 can be single-acting, the inertia of the member 19 on its retraction carrying it away from contact with the head 18.

The actuator units 20 are controlled such that, while the feeder is working, at least one of the rollers 13 is displaced from the path of its cam 14, and the appropriate actuator unit 20 is energized when a signature 2 having an overlap is to be opened. For each of the fingers 5 and 6, the opening movement (for instance from the full-line position to the chain-dotted-line position of the finger 6) is positively driven by the rotation of the cam 14, and its return is driven by the draw spring 12. Due to the arrangement of the respective drives formed by the connecting rods 10, pivoting members 11, rollers 13 and cams 14, the fingers 5 and 6 operate in opposite directions so that signatures 2 having overlaps can be opened whichever way up the signatures 2 are. As can be seen in FIG. 2, where the signature 2 is shown as having an overlap 21 on its upper part, the finger 6 will push the upper part of the signature away from the lower part, and this initial opening movement can be completed by the member 4, which extends at least as far as the middle of the signature 2.

MODIFICATIONS OF THE EMBODIMENT DESCRIBED

Without departing from the principle of the invention, the details of the embodiment described can be widely varied.

I claim:

1. A signature opener for opening signatures having an overlap, the opener having a conveyor, a rotatably-mounted opening member and a drive therefor, for engaging the overlap and pushing the part of the signature having the overlap away from the other part, thereby opening or initiating the opening of the signature, characterized in that there are two opening members (5 and 6) rotatably mounted about the same axis (7), the opening members and the respective drives (10, 11, 13 and 14) being arranged such that the opening members operate in opposite directions, and in that the opener includes control means (20) for energizing one of the opening members at a time, so that signatures (2) having overlaps (21) can be opened whichever way up the signatures are.

2. The opener according to claim 1, characterized in that the axis (7) of rotation of the opening members (5 and 6) is to one side of the conveyor, in the plane of conveyance, and parallel with the direction of conveyance.

3. The opener according to claim 1, characterized in that the drives (10, 11, 13 and 14) are for oscillating the opening members (5 and 6) and include a reciprocating connecting rod (10) for each opening member, one connecting rod being connected to the respective opening member on one side of the common axis (7) of the opening members and the other connecting rod being connected to other opening member on the other side of the common axis.

4. The opener according to claim 1, characterized in that the drives (10, 11, 13 and 14) are for oscillating the opening members (5 and 6) and include, for each respective opening member, a rotary cam (14) and cam follower (13) and means for rotating the cam continuously, said control means including a pressure-fluid actuator (20) to disengage the cam and cam follower by relative movement parallel to the axis of the cam.

5. The opener according to claim 4, characterized in that each cam follower (13) is mounted for movement parallel to the axis of rotation of its cam (14) and is spring-biassed into a position in which it engages its cam, a part (15) which is effectively fixed to the cam follower as regards movement parallel to the axis of rotation of the cam, having an abutment surface for moving the cam follower against the spring biassing to a position in which the cam follower engages its cam, the respective pressure-fluid actuator (20) having an abutment member (19) which, on actuation of the pressure-fluid actuator, thrusts said actuating surface to displace the cam follower from the path of the cam.

6. The opener according to claim 5, characterized in that each cam (17) is profiled such that the respective cam follower (13) does not engage the surface of the cam in at least one arc of rotation of the cam, the pressure-fluid actuator being automatically controlled such that it is actuated in this arc.

* * * * *